United States Patent [19]

Guthrie

[11] 4,116,151

[45] Sep. 26, 1978

[54] WIND POWERED APPARATUS

[76] Inventor: John Guthrie, Suite 1401-555-13th St., West Vancouver, British Columbia, Canada, V7T 2N8

[21] Appl. No.: 824,624

[22] Filed: Aug. 15, 1977

[30] Foreign Application Priority Data

Sep. 8, 1976 [CA] Canada ..... 260709

[51] Int. Cl.[2] ..... B63H 9/06

[52] U.S. Cl. ..... 114/102; 114/39; 114/104

[58] Field of Search ..... 114/102–105, 114/39

[56] References Cited

FOREIGN PATENT DOCUMENTS 1,423,958 11/1965 France ..... 114/39

1,531,655 1/1970 Fed. Rep. of Germany ..... 114/39

1,956,380 5/1971 Fed. Rep. of Germany ..... 114/39

1,134,312 11/1968 United Kingdom ..... 114/39

*Primary Examiner*—Stephen G. Kunin

[57] ABSTRACT

A wind-powered apparatus includes a series of vertically extending transversely curved foils carried in a support and movable longitudinally of the support from a furled condition, where the foils are bunched closely together and present a minimum surface area to the wind, to an unfurled position where the foils are uniformly spaced along the support. The support can be rotated to take advantage of the wind direction, and the foils themselves can be rotated in unison to one side or the other. The various movements of the foils are powered by suitable drive mechanisms which may be remotely controlled.

8 Claims, 12 Drawing Figures

MOVEMENT 'A'
FURLING & UNFURLING

WIND POWERED APPARATUS

BACKGROUND OF THE INVENTION

This invention relates to a new or improved wind-powered apparatus, and in particular to such an apparatus which includes a bank of foils which can be deployed and oriented to take best advantage or prevailing wind conditions. The wind-powered apparatus is particularly, although not exclusively, suitable for use a means for propelling a boat.

SUMMARY OF THE INVENTION

The present invention comprises a wind-powered apparatus comprising: an elongate support; a series of elongate generally parallel foil devices carried on said support, said foil devices extending normally to said support and being uniformly spaced longitudinally thereof; extension means in said support being operative to move said foil devices in unison longitudinally of said support to vary selectively said uniform spacing; each said foil device being rotatable about an axis parallel to its length, means maintaining said foil devices in identical orientation about their respective axes and operative to rotate said foil devices in unison selectively to vary said orientation; and means operative to pivot said support about a vertical axis to position said foil devices in a selected vertical plane.

The extension and retraction movement of the foil devices longitudinally of the support corresponds to the unfurling and furling of the sails of a conventional sailboat, and may be effected by any suitable mechanism. For example the individual foil devices may be connected at spaced points in a lazy tongs linkage. The foil devices are preferably identical and of constant width from top to bottom. However in certain cases it may be desirable to design the foil devices with a width which tapers from bottom to top, and the width of the foil devices may be varied along the length of the support.

Suitable power drive mechanisms may be provided to effect the various movements of the wind-powered apparatus, namely foil extension/retraction, foil rotation, and support rotation. Alternatively, or additionally, means may be provided for manual actuation of the drive mechanisms.

BRIEF DESCRIPTION OF THE DRAWINGS

The invention will further be described, by way of example only, with reference to the accompanying drawing wherein;-

DESCRIPTION OF THE PREFERRED EMBODIMENT

Figure 3:
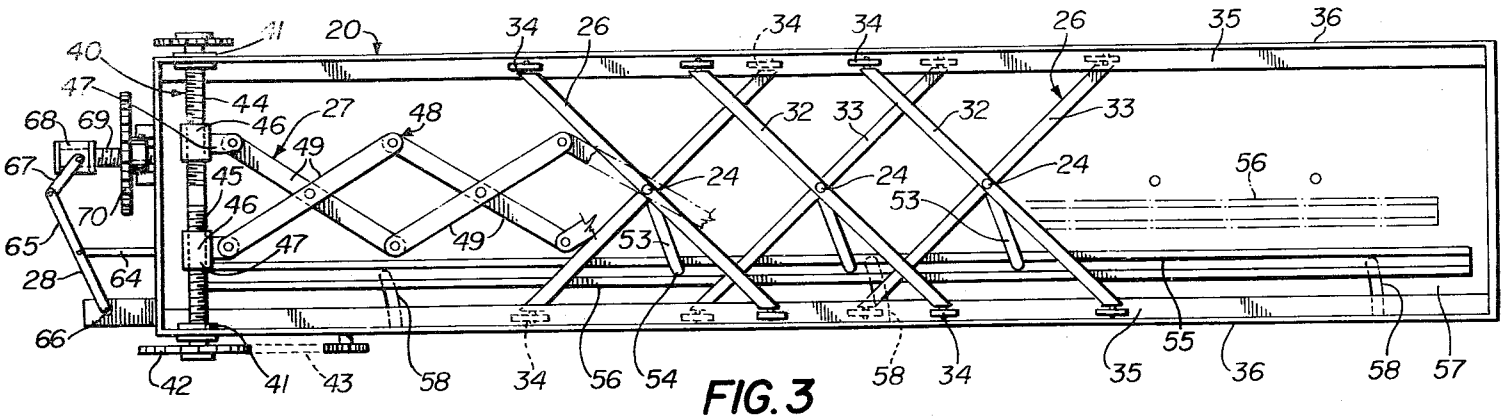
FIG. 3 is a sectional view, on a reduced scale, taken on the line III—III in FIG. 2.
Figure 4:
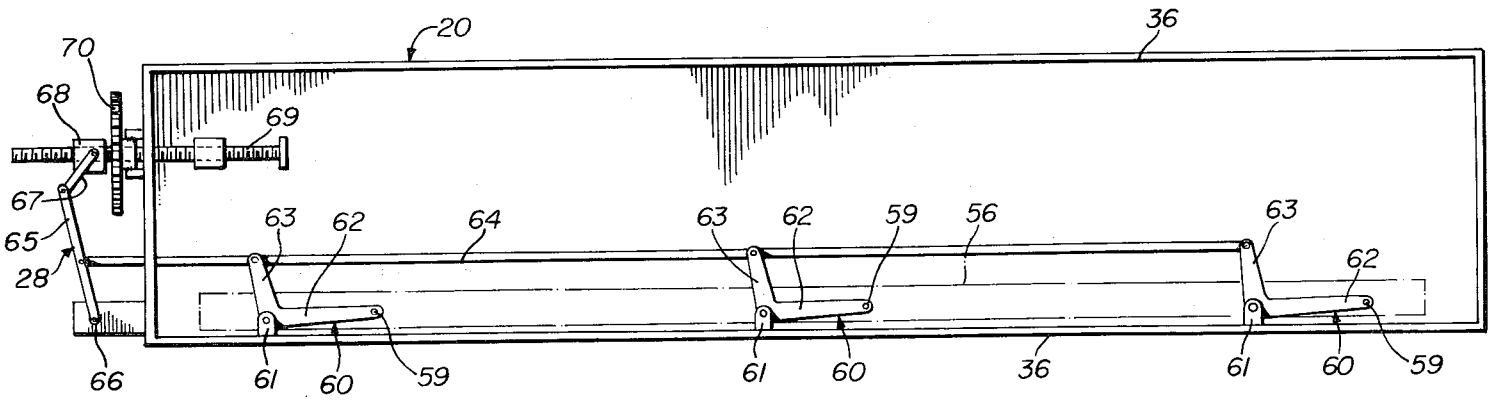
FIG. 4 is a sectional view, with parts omitted for reasons of clarity, taken on the line IV—IV in FIG. 2.
Figure 5:
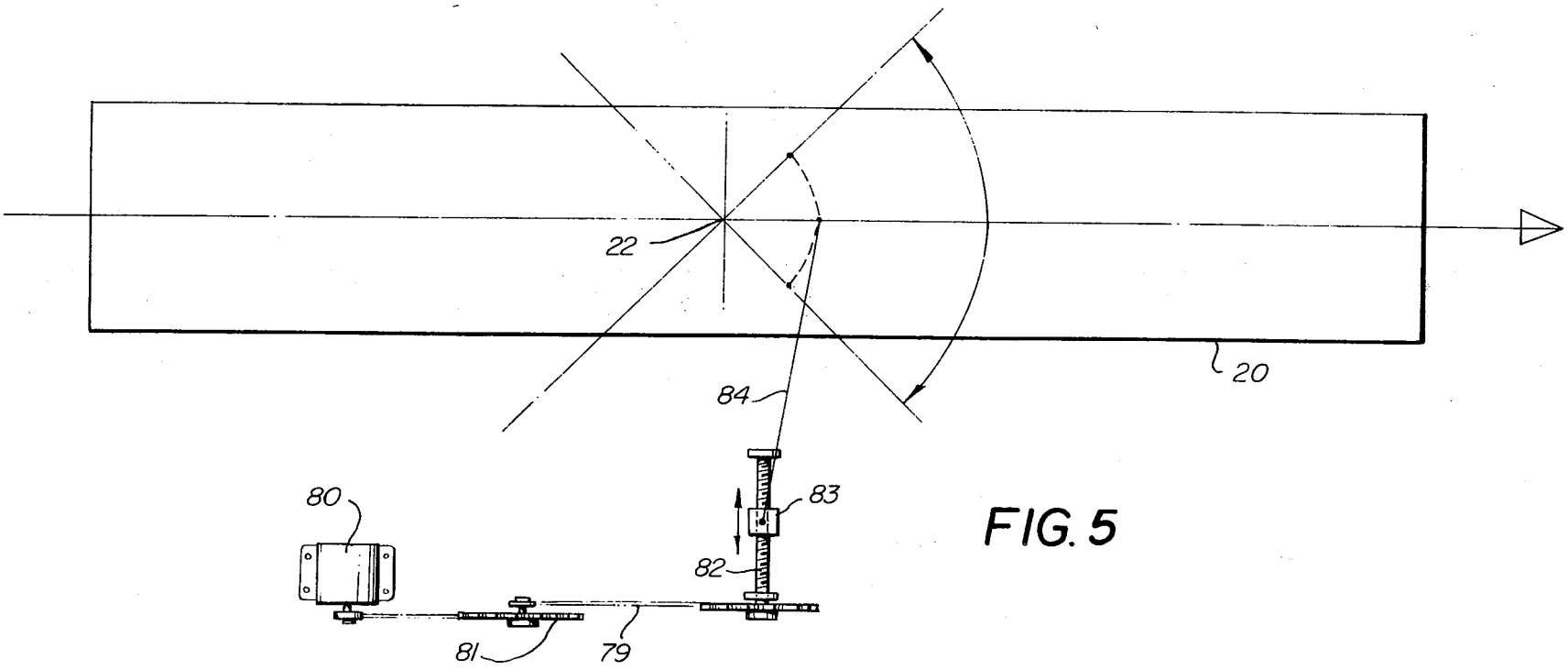
FIG. 5 is a schematic view illustrating the mechanism for driving rotation of the support of the wind-powered apparatus.

Referring to FIGS. 1–5, the wind-powered apparatus comprises a support 20 rotatably mounted upon a base 21 to be pivotable about a vertical axis 22 (FIG. 5).

Figure 1:
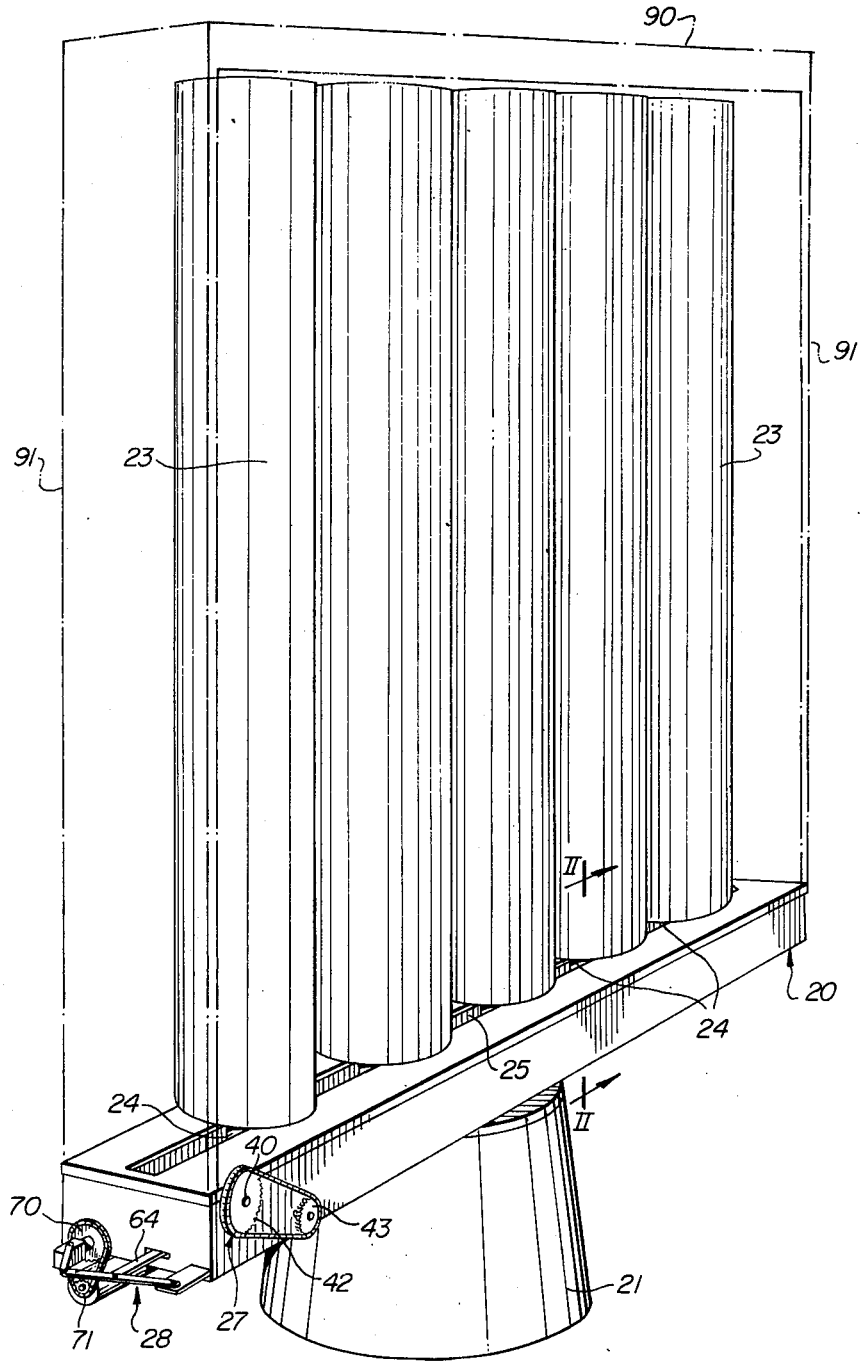
FIG. 1 is a somewhat schematic perspective view of a wind-powered apparatus in accordance with the invention.
Figure 2:
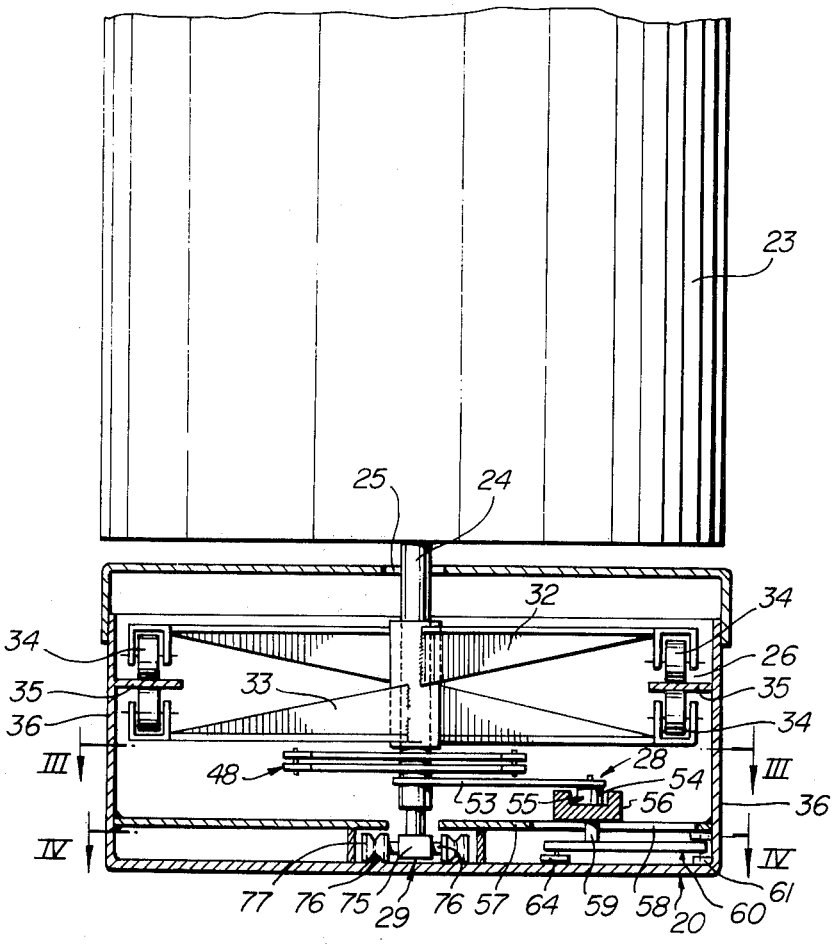
FIG. 2 is a fragmentary sectional view to an enlarged scale taken on the line II—II in FIG. 1.
Figure 2A:
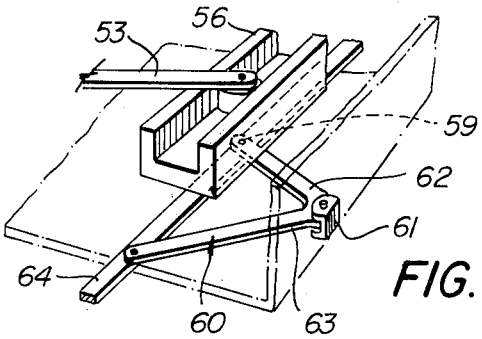
FIG. 2A is a fragmentary perspective view showing a detail of the mechanism shown in FIG. 2.

The support carries a number of vertically arranged paralled foils 23, uniformly spaced therealong. The foils 23 are identical, each being of the same height and width, and having a crescent shaped horizontal cross-section as indicated in FIGS. 8–11. Each foil is of light-weight hollow construction and is carried on a vertical spindle at its lower end, which is received through a longitudinal slot 25 in the support 20. Referring to FIGS. 2 – 4, within the support 20, each foil spindle 24 is coupled to a bracing structure 26, an extension/retraction mechanism 27, a rotating mechanism 28 and a bearing structure 29.

With particular reference to FIGS. 2 and 3, the bracing structure for each foil 23 comprises upper and lower, tapered diagonally arranged arms 32 and 33 respectively, attached, as by welding, to a vertical bearing **33*a* through which the spindle 24 passes. Each end of the upper diagonal arm 32 carries a bearing roller 34 which engages the upper surface of a narrow flange 35 which projects from the side wall 36 of the support 20. The lower diagonal arm also carries bearing rollers 34 on its outer ends, these rollers engaging the undersides of the flanges 35. It will be appreciated that this bearing structure supports the spindle 24 against moments in any vertical plane applied by the force of the wind upon the foil 23. Irrespective of the direction in which the moment is applied, the bearing rollers 34 will interact with the flanges 35 to maintain the spindle 24 in its upright deposition. Furthermore, although the bracing structure 26 provides each foil 23 with a support base of substantial area within the horizontal support 20, by virtue of the vertically spaced arrangement of the upper and lower diagonal arms 32 and 33, the bracing structures 26 of adjacent foils 23 do not interfere with each other, and accordingly do not restrict the ability of the spindles 24** to be moved to closely adjacent positions.

The mechanism for effecting extension and retraction movements of the foils longitudinally of the support is best seen in FIG. 3 and comprises a screw-threaded shaft 40 rotatably mounted in bearings 41 in the side-walls 36 at one end of the support 20. One end of the shaft extends beyond the support and carries a sprocket wheel 42 coupled to a chain drive mechanism 43 powered by an electric motor (not shown) carried in the support. The shaft 40 has two sections 44 and 45 which carry screw-threads of opposite hands. Each threaded section of the shaft is engaged by screw-threaded nut 46 having a radial lug 47 which forms a pivotal connection to a linkage structure 48 in the form of a lazy tongs. The structure 48 comprises a series of pairs of horizontally arranged links, each pair of links being pivoted about their midpoints on a respective one of the foil spindles 24. The ends of each intermediate pair of links are pivotally connected to the ends of adjacent pairs of links, the first pair of links being pivotally connected to the radial lug 47.

With the above described structure, it will be appreciated that upon rotation of the shaft 40, the nuts 46 will be moved in opposite directions, and that the spindles 24, while being maintained at equal mutual spacings, will be moved longitudinally of the support 20. The mechanism 27 thus perform a furling and unfurling action, and can cause the foils to move between the furled position shown in FIG. 8 where they are bunched together at one end of the support, to the unfurled position shown in FIG. 9, where they are arranged at maximum mutual spacing.

The foil rotating mechanism 28 is best shown in FIGS. 2, 2A, 3 and 4 and comprises a radial arm 53 keyed to each of the spindles 24 beneath the lazy tongs linkage 48. Each of the radial arms 53 carries at its free end a roller 54 arranged to rotate about a vertical axis and received in a groove 55 in a channel member 56 extending throughout the length of the support 20 and slidably carried upon a horizontal wall 57. As seen in FIG. 3, at three spaced locations throughout the length of the wall 57 there are arcuate slots 58 through each of which projects a pin carried on the underside of the channel member 56.

Within the support 20 and beneath the wall 57, three cranked levers 60 are each pivotally mounted in a clevis 61 attached to the support to be movable thereon in a horizontal plane. Each crank lever 60 (see FIG. 2A) has one arm 62 pivotally connected to a respective one of the pins 59 on the channel member 56, and a second arm 63 pivotally coupled to a connecting rod 64 which extends longitudinally within the support 20 and projects from one end thereof. The end of the connecting rod 64 is in turn pivotally attached to a link 65 one end of which is carried on a fixed pivotal mounting 66 on the support. The other end of the link 65 is coupled through a pivoted intermediate link 67 to a nut 68 received on a threaded shaft 69 rotatably carried in the end of the support 20. A sprocket 70 keyed to the shaft 69 is connected for rotation through a drive mechanism 71.

Upon operation of the drive mechanism 71 to rotate the shaft 69, the connecting rod 64, through the action of the nut 68, intermediate link 67 and link 65, will be moved longitudinally in one or other direction according to the direction of rotation of the shaft. Longitudinal movement of the connecting rod 64 in turn will cause pivotal movement of each of the cranked levers 60 about it clevis mounting 61, the channel member 56 in turn being moved (generally transversely of the support 20) through the interaction of the pins 59 with the arms 62 of the cranked levers 60. Through their couplings with the connecting rod 64, the cranked levers 60 pivot in unison, causing the pins 59 to move along the arcuate slots 58. The channel member 56 is thus moved in the direction of the slots 58, i.e. generally transversely of the support 20, maintaining throughout its range of movement an orientation parallel to the length of the support.

Figure 8:
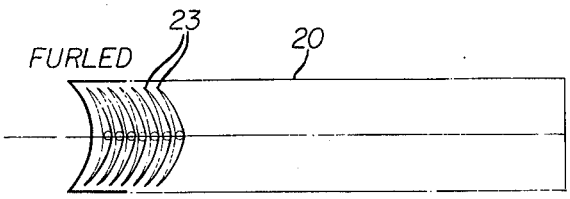
FIGS. 8–11 are schematic views showing various arrangements and orientations of the foils of the apparatus shown in FIGS. 1 – 5.

Through the interaction of the rollers 54 with the longitudinal groove 55 in the channel member 56, the radial arms 53 of the foils are caused to pivot in unison to follow movements of the channel member 56. Accordingly the rotating mechanism 28 comprising the drive 71, the connecting rod 64 and the channel member 56 is effective to cause rotation of the foil spindles 24 in unison, and hence is effective to vary selectively the orientation of the foils 23 about the vertical axis of their spindles. It will be noted that this foil rotating mechanism is not dependent upon any particular mutual spacing of the foils longitudinally of the support. As the foils are extended or retracted longitudinally on the support through operation of the furling mechanism 27, the rollers 54 slide along the groove 55 in the channel member 56, and accordingly extension or retraction of the foils can be effected without interfering with the operation of the rotating mechanism 28. Of course, when the foils are in the fully furled position as shown in FIG. 8, little or no foil rotation is possible, since such a rotation would be to a large extent prevented through fouling of adjacent foils. However substantial foil rotation becomes possible even when the foils are moved only slightly from the furled position.

The degree of foil rotation possible is determined by the geometry of the mechanism and of the foils themselves. It has been found that a total range of foil rotation of 60° provides an adequate range of operation.

The bearing structure 29 supporting the lower end of each foil spindle 24 comprises a block 75 in which the end of the spindle is received, the block carrying a short horizontal axle 76 at each end of which is rotatably supported a grooved roller 77. The rollers 77 are guided for movement longitudinally of the support 20 by tracks formed by angular ridges 78 extending longitudinally of the support 20.

To effect rotation of the support 20 about its vertical axis 22 to present the foils 23 at a desired orientation to the prevailing wind direction, a drive mechanism 79 is provided within the base 21 as schematically shown in FIG. 5. The mechanism comprises an electric motor 80 coupled through a speed reducing mechanism 81 to rotate a threaded shaft 82. A nut 83 engages the shaft 82 and is connected to the support 20 through a pivoted link 84. Rotation of the shaft 82 acts through the nut 83 and link 84 pivot the support 20 to the desired orientation. A total range of pivotal movement for the support 20 of 90° has been found to be sufficient.

Figure 6:
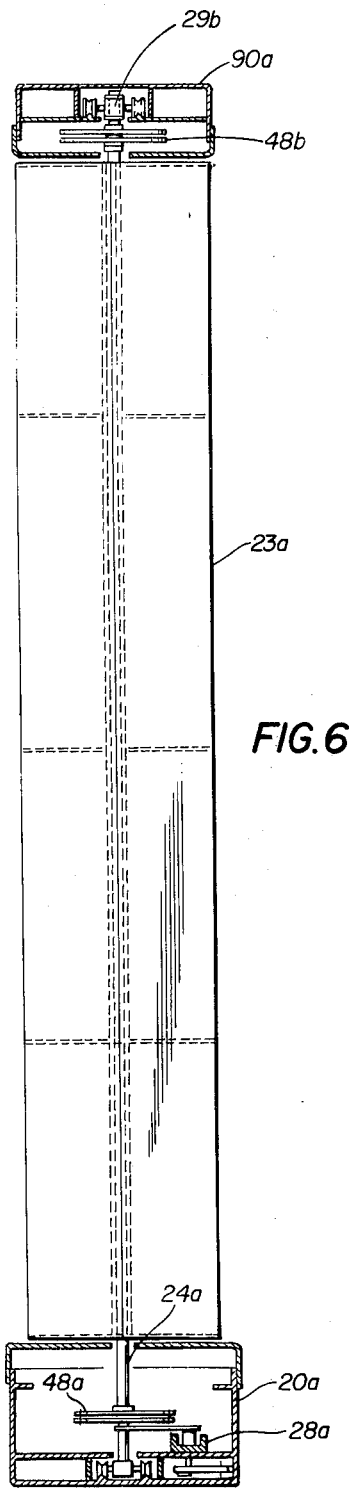
FIG. 6 is a vertical cross-sectional view of a modified form of wind-powered apparatus.
Figure 7:
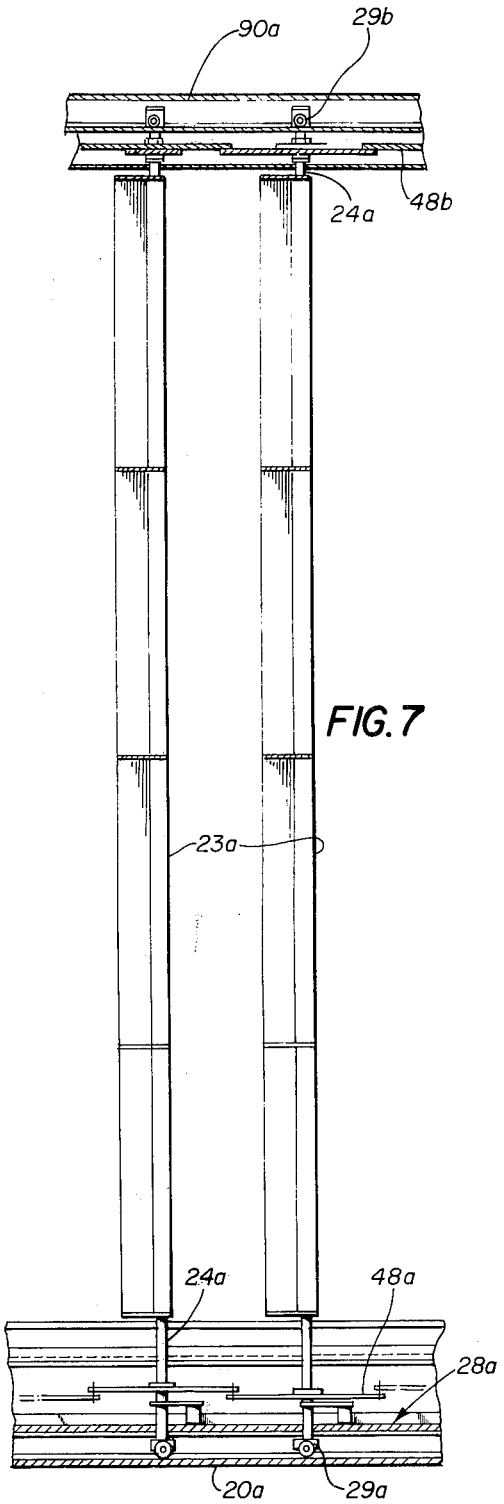
FIG. 7 is a fragmentary partly sectioned side view of the apparatus shown in FIG. 6.

In the wind-powered apparatus described above in relation to FIGS. 1–5, the foils 23 are free-standing, being interconnected only at their lower ends within the support 20. The overall dimensions of each foil can vary widely, for example the width to length ratio of the foils may be between 1:5 and B 1:20. Where the foils are of very large size, or extremely long, it may be advisable to provide support for them at their upper ends also. Such an arrangement is illustrated in broken lines in FIG. 1, wherein the upper ends of the foils 23 are received within a horizontal top frame member 90 supported between upright frame members 91 carried at opposite ends of the bottom support 20. Such an arrangement is illustrated more fully in FIGS 6 and 7. In this arrangement foils 23*a* are supported in spindles 24*a*, the lower ends of which are received within a bottom support frame member 20*a* and coupled to a lazy tongs extension/retraction linkage 48*a*, a rotating mechanism 28*a* and a bearing structure 29*a* similar to those described for the embodiment of FIGS 1–5. However in place of the previously described lower bracing structure 26, the foils 23*a* are supported at their upper ends within a top frame member 90*a*. The upper ends of the foil spindles 24*a* are interconnected through a lazy tongs linkage extension/retraction mechanism 48*b* exactly corresponding to the lower mechanism 48*a*. The mechanisms 48*a*. and 48*b* are arranged to operate in unison, to maintain the foils 23*a* always in a vertical disposition. The upper ends of the foil spindles 24*a* are also supported and guided by a bearing structure 29*b* within the top frame 90*a*, and similar to the bearing structure 29 described in relation to FIGS. 1–5.

From the foregoing description it will be understood that the wind-powered apparatus can be rotated about a vertical axis to position the foils in a desired vertical plane, and all of the foils can rotate in unison about their spindles. The foils can be extended (unfurled) or retracted (furled) as needed. When fully retracted the surface area of the foils exposed to the wind will be at a minimum.

Figure 9:
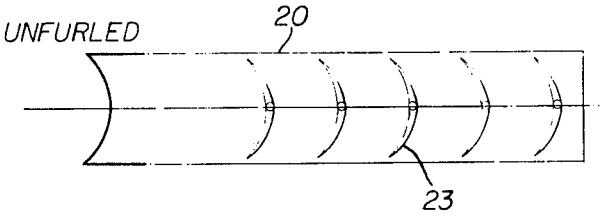
Figure 10:
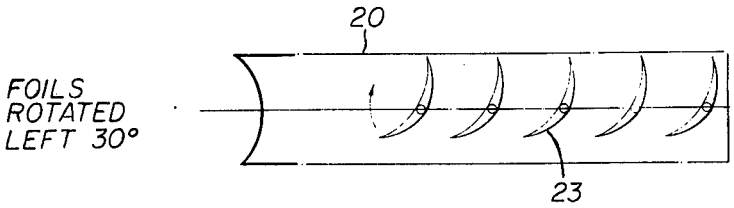
Figure 11:
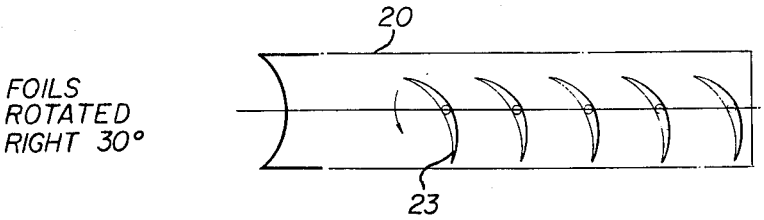

The surface area of the foils available to obtain the windpower will vary according to the individual foil dimensions, the number or foils, the degree of extension of the foils longitudinally of the support, and the degree of foil rotation. These various conditions are illustrated in FIGS. 8–11, FIG. 8 showing the foils fully retracted; FIG. 9 showing the foils fully extended or unfurled, and in a central position in their range of rotation; FIG. 10 showing the foils related 30° in one direction; and FIG. 11 showing the foils related 30° in the opposite direction.

The power to effect movements of the various parts of the wind-powered apparatus may be derived from any suitable source, for example electric, pneumatic, hydraulic, or mechanical motors or combinations thereof, and by the use of suitable control systems, operation of the device can be effected from a remote control center.

The thickness and curvature of the foils 23 are designed to obtain best effect from the wind. The foil thickness should be the minimum consistent with adequate strength. The curvature of the foils as shown in the accompanying drawings is of a radius approximately equal to three quarters of the foil width, but this is not a limiting factor. The spacing of the foils when fully extended in the embodiments shown is approximately three quarters of their width.

What I claim as my invention is:

1. A wind-powered apparatus comprising:

an elongate support;

a series of elongate generally parallel foil devices carried on said support, said foil devices extending normally to said support and being uniformly spaced longitudinally thereof;

extension means in said support being operative to move said foil devices in unison longitudinally of said support to vary selectively said uniform spacing;

each said foil device being rotatable about an axis parallel to its length, means maintaining said foil devices in identical orientation about their respective axes and operative to rotate said foil devices in unison selectively to vary said orientation;

and means operative to pivot said support about a vertical axis to position said foil devices in a selected vertical plane.

2. Apparatus according to claim 1 wherein said foil devices are movable longitudinally of the support to and from a limiting position in which the foil devices are bunched closely together and occupy a minimum area in said vertical plane.

3. Apparatus according to claim 2 wherein each foil is of constant profile and is convexly curved transversely of its length and is rotatable about its axis through an angular range of at least 60°.

4. Apparatus according to claim 1 wherein said foils are supported at only their lower ends in the support, the upper ends of the foils being free.

5. Apparatus according to claim 4 wherein each said foil is carried on a spindle which defines said axis, each said spindle having within said support, associated bearing means operative to guide the spindle in movements along the support, and associated bracing means operative to resist wind imposed tilting moments applied to the foil.

6. Apparatus according to claim 5 wherein said bracing means comprises two flanges extending longitudinally of the support on opposite sides thereof each foil spindle having an associated bracing structure supporting bearing rollers in spaced arrangement in rolling contact with said flanges and operative to retain said spindle normal to said support.

7. Apparatus according to claim 5 wherein said means to rotate said foils comprises: a guide channel extending longitudinally of said support, means for moving said guide channel transversely of said support while maintaining it parallel to the length of the support, a radial arm fixed to each foil spindle having a follower received in said guide channel to be movable longitudinally of the channel during movement of the foils longitudinally of the support, said guide channel cooperating with said follower to rotate said foils in unison in response to movement of the guide channel transversely of the support.

8. Apparatus according to claim 2 wherein said foils are enclosed within a frame having upper and lower horizontal members and spaced vertical members, the lower horizontal member constituting said suport and the upper horizontal frame member including means to support and guide the upper end of each foil during extension, retraction and rotation thereof.

* * * * *